United States Patent [19]

Sullivan

[11] 4,089,880

[45] May 16, 1978

[54] PROCES FOR REFINING FATTY OILS

[75] Inventor: Frank E. Sullivan, Tiburon, Calif.

[73] Assignee: Sullivan Systems Inc., Tiburon, Calif.

[21] Appl. No.: 678,404

[22] Filed: Apr. 19, 1976

Related U.S. Application Data

[63] Continuation-in-part of Ser. No. 558,076, Mar. 13, 1975, abandoned.

[51] Int. Cl.[2] ..... C11B 3/04

[52] U.S. Cl. ..... 260/424; 260/419; 260/428

[58] Field of Search ..... 260/424, 428, 419; 203/92; 426/488

[56] References Cited

U.S. PATENT DOCUMENTS

| | | | |
|---|---|---|---|
| 2,594,953 | 4/1952 | Mares | 260/428 |
| 2,795,543 | 6/1957 | Opie | 260/424 X |
| 3,172,922 | 3/1965 | Kehse | 260/428 X |
| 3,455,975 | 7/1969 | Martinenghi | 260/428 |
| 3,506,696 | 4/1970 | Baker et al. | 260/428 |
| 3,590,059 | 6/1971 | Velan | 260/424 |
| 3,622,466 | 11/1971 | West | 260/428 X |
| 3,780,076 | 12/1973 | Papahronis et al. | 260/420 |
| 3,895,042 | 7/1975 | Taylor | 260/424 |
| 3,984,447 | 10/1976 | Cooper et al. | 260/420 |

OTHER PUBLICATIONS

*Refining of Oils and Fats,* Anderson, A Ind. Eg. 2nd Ed., MacMillen, N. Y. (1962) p. 95.

*Primary Examiner*—Winston A. Douglas
*Assistant Examiner*—John F. Niebling
*Attorney, Agent, or Firm*—Owen, Wickersham & Erickson

[57] ABSTRACT

A continuous process for steam-refining crude fatty oils or crude degummed fatty oils to remove free fatty acids, odoriferous material, and color bodies and thereby to produce a fully deodorized, high stability, bland, finished oil. Following degumming, if needed, the crude fatty oil is pretreated with phosphoric (or citric) acid while excluding air and oxygen, to react trace metals and other contaminants and then the oil is treated with absorptive clay under specified conditions of moisture, vacuum, and temperature to remove the trace metals and most of the color bodies from the oil. The filtered oil is then steam refined, under specified conditions of steam sparging, vacuum and temperature, to remove free fatty acids, odoriferous material, and other volatile non-fatty oil material, and to destroy certain color bodies. The process may also include fractionating and recovering, as separate products, the fatty acids and other stream-distilled material contained in the crude fatty oils.

26 Claims, 1 Drawing Figure

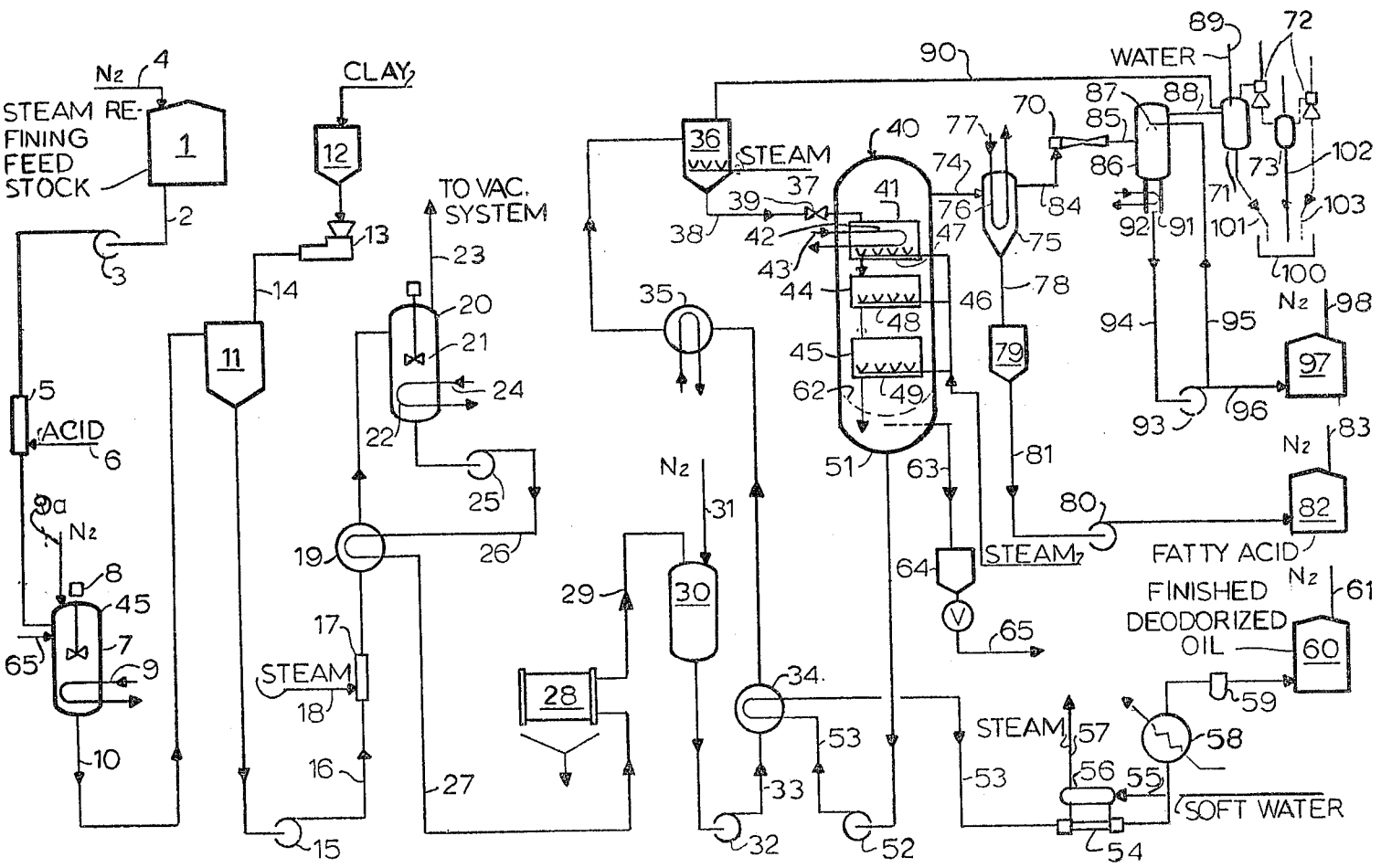
STEAM RE-
FINING
FEED
STOCK
N2
ACID
CLAY
TO VAC.
SYSTEM
STEAM
WATER
FATTY ACID
FINISHED
DEODORIZED
OIL
SOFT WATER

PROCES FOR REFINING FATTY OILS

REFERENCE TO RELATED APPLICATION

This application is a continuation-in-part of application Ser. No. 558,076, filed Mar. 13, 1975 now abandoned.

BACKGROUND OF THE INVENTION

This invention relates to the refining of crude fatty oils.

The oil to be refined may be naturally free of phospholipids, as are palm oil, coconut oil and the other lauric acid oils, and animal fats. Or it may be a crude oil which contains phospholipids, as do soybean oil and safflower seed oil, for example. In the latter instance, the process includes degumming as a first step. How degumming is achieved is not part of this invention; usually the phospholipids are removed by a well-known technique of water hydration and centrifugal separation.

In the United States such oils have heretofore been refined by a caustic refining process. This process resulted in high losses and usually required further refining processes.

The present invention employs steam distillation and does not utilize caustics.

Perhaps one reason for the historical popularity of the caustic refining process in the United States was that until the 1940's, cottonseed was the principal source of crude oil for shortening or salad oil in the United States. This dark crude oil could not be steam-refinined, due to color problems. It was therefore necessary to caustic-refine this oil for fatty-acid removal as well as for removal of color bodies.

Cottonseed oil was followed as the popular salad or shortening oil by soybean oil, which has also been difficult to steam-refine, because the principal non-oil constituents of this oil are phospholipids. It is now known that these components must be thoroughly removed from the oil prior to high-temperature steam deodorization, and I have found that such removal makes steam refining quite practical. Phospholipids vary in their composition, primarily due to growing conditions of the basic soybean. At one time caustic refining was thought to be the only practical way to remove phospholipids, and even then, when certain types, such as nonhydratable phospholipids, were present, those required a special acid pretreatment before the caustic refining, followed by intensive bleaching with activated clay in order to produce an acceptable product.

However, this standard caustic refining process, has been difficult to use for refining certain types and grades of oil, and the losses have been high in any event. For example, for palm oil published refining losses have usually ranged from a low of 1.7 times free-fatty-acid (FFA) to over 2.2 times FFA. On a crude oil of 4.0% FFA with an average refining factor of 2.0, the loss would thus be about 8%, a very significant loss, leaving a refined yield of only 92 pounds for every 100 pounds of crude oil purchased. Even then, the caustic-refined palm oil would still have to be bleached and steam-deodorized.

The large amount of soapstock produced from this 8% refining loss resulting from caustic refining resulted in a difficult by-product that had to be processed further. It has usually been acidulated with sulfuric acid to make a low-grade fatty-acid oil. The effluent from the acidulation process is very high in biochemical oxygen demand and has had to be neutralized and treated before discharge into a sewer system.

Yet, palm oil has a natural versatility among edible oils because of its glyceride structure. It has good non-foaming properties and oxidative stability that makes it highly suitable for use in commercial deep frying. The plantations of Malaysia are now producing high-quality palm oil in sufficient quantities to permit its use in the production of frying fats, as well as margarine and shortenings, and the present invention enables its refinement with only negligible losses and enables recovery of salable by-products.

Palm oil, if properly refined has a composition that makes it a nearly ideal food fat substance. One disadvantage, however, has been the presence of from 400–800 ppm of carotenoid pigments, particularly formed from $\alpha$ and $\beta$ carotenes. These products impart to palm oil a dark red color that is unacceptable for a food fat.

The normal method of "bleaching" palm oil has, in the past, consisted of holding the palm oil, for one hour or more, under vacuum, at temperatures on the order of 240° C. Under these conditions, the carotenes have undergone successive intramolecular Diels-Alder reactions; one double bond reacted with two conjugated double bonds to form a six-carbon ring, with diminished unsaturation. $\beta$-carotene has 40 carbon atoms and 11 chromophoric conjugated double bonds. After bleaching by this prior-art heat treatment, the largest part has been recovered in the form of a mixture of polycyclic products which still contained 40 carbon atoms, but for which the number of double bonds was on the order of 2 to 3 per molecule. These products were colorless or very faintly colored; however, they were not eliminated either by treatment with decolorizing earth nor by deodorization. The volatile fraction particularly consisting of toluene, xylenes, and the methylnaphthalenes represented on the order of only 15 to 20% of the carotene.

When palm oil was, instead, "bleached" by treatment with decolorizing earths at temperatures between 100° and 180° C., the decolorization was due principally to the adsorption of pigments but more particularly to an isomerization catalyzed by the earth; furthermore, this bleaching, called "mixed", produced a high proportion of polymers of polyunsaturated fatty acids.

Both these classical procedures for decolorization of palm oil presented the added disadvantage of leaving, in the refined oil, substances extremely suspect from the toxicological point of view.

An important consideration in the pretreatment portion of the present invention is the removal of most of the $\beta$-carotene prior to the high temperature treatment by steam refining. $\beta$-carotene is a heat degradable material which is converted to a colorless polycyclic non-volatile product by conventional heat bleaching; however, the heat degraded residues which then remain can seriously reduce stability. By removal of the $\beta$-carotene prior to high temperature treatment, a more stable finished edible oil is produced. Typical good crude palm oil may contain 450–500 ppm $\beta$-carotene. The filtered oil, after the metal removal and clay bleaching steps according to the present invention, contain only 25–30 ppm $\beta$-carotene, more than 90% of the carotene being removed by the metal removal and bleaching steps. This treated oil is then used as the feed stock which is steam refined and deodorized to produce the finished edible oil.

Deacidification of certain high-FFA crude oils using steam distillation as a primary refining step has been carried out in Europe for many years as a replacement for the basic caustic refining method. In practice of this method; it had been found difficult to reduce the free-fatty-acid content of the oils below 0.1–0.2%. As such, the steam distillation was usually carried out to reduce the FFA to the 0.5–0.6% range, and then the refining was completed by the basic caustic refining process. In order to produce a finished edible oil, the caustic refining step still had to be followed by conventional bleaching and steam deodorization.

High quality finished edible oil can only be produced from good quality crude oils. Crude palm oils contain natural antioxidants, for example tocopherols, which help in reducing the rate of oxidation while in the crude oil. Crude palm oil can be further protected at the time of shipment, e.g., from Malaysia, by the addition of further antioxidants, as well as protection by nitrogen blanketing, thereby helping to reduce oxidation during transit. A sample of crude palm oil which had 0.01% TBHQ (tert. butyl hydroquinone) added before shipment was pretreated, steam refined, and deodorized according to the present invention to produce a finished oil color of less than 0.6R.

While the quality of crude palm oil as obtained at the plantations, for example Malaysia, has improved greatly over the years due to a better understanding of the technology in processing the oil from the palm pod, oxidation during the refining processes has caused trouble. It is important to minimize oxidation in and of the crude oils.

Technical studies have shown a definite relationship between the total oxidation values of a fat and the keeping quality of the finished product. The total oxidation values, or "*Totox,*" is an empirical value derived from the peroxide value [PV] and the anisidine value [AV]. Therefore Totox = [2 × PV] + AV where PV is a measure of the peroxides formed and the AV is a measure of the secondary oxidation products.

In a series of palm oils which were processed by conventional caustic refining, bleaching and deodorization, the average AV of the deodorized oil was 6.0 which, with a zero PV, gave a Totox of 6.0. In a review of quality requirements for palm oil used in margarine, it has been reported that a good margarine oil should have a Totox below 4.0. Previously this value has been unattainable.

Typical good crude palm oils show the following analyses:

Free fatty acid [FFA] = 3.2%–4.2% [average 3.5%]
β-carotene = 450–500 ppm
Peroxide value [PV] = 3–6 milliequivalents/Kg
Anisidine value [AV] = 4–7
*TOTOX* = 10–19 [average 12–15]

Such crude palm oil, when processed from crude to deodorized finished oil by the process of the present invention results in finished deodorized edible oil with the following analyses:

Color = 1.5R - 2.5R [5¼ in. Lovibond]
FFA = 0.02%
β-carotene = 35–70 ppm
PV = 0.0
AV = 1.0 - 3.0
*TOTOX* = 1.0 - 3.0

Further illustrating the relationship of crude oil quality, a parcel of crude palm recently received had an AV of 2.0 with a Totox of only 10.6. The finished deodorized oil produced by the process of the present invention analyzed with a color less than 10Y–1.0R and a Totox of 0.8.

It has been reported that caustic-soda refining removed or destroyed a part of the natural anti-oxidants, and hence the refined oil is not as stable as the crude oil. This became apparent when crude oils were caustic-soda refined at the plantations and shipped as a once-refined oil [only caustic-soda refined]. Certain of these oils have analyzed, upon receipt in the U.S.A., with Totox value between 60–100.

Oils, other than crude palm, have also been processed by the present process using this laboratory technique. Among those successfully processed have been soybean oil, corn oil, peanut oil, sesame oil, olive oil, coconut oil, babassu and palm kernel oils, tallows and lard.

Each type of crude oil usually requires some minor variation in the pretreatment prior to high temperature steam refining and deodorization. Oils containing phospholipids, for example soybean oil, require a thorough water degumming to remove all or nearly all water hydratable phosphorous compounds. The gums from the water degumming operation may be dried and sold as animal feed, or if the crude oil is free of meal, the dried material may be sold as edible lecithin. The finished deodorized soybean oil was equal to or better than deodorized oil produced by the conventional processing, in its keeping quality characteristics.

The principal advantage for steam refining and deodorizing a low acidity oil such as soybean, peanut et al, is in the reduction of plant pollution commonly caused by the acidulation of soapstock produced from conventional caustic refining.

Thus, one object of the invention is to provide an improved oil refining process that significantly reduces refining losses and at the same time enables use of a large proportion of the materials removed during the refining process.

Another object is to provide a simple continuous refining process requiring little labor and minimum supervision.

Another object is to provide a greatly improved steam refining process for crude fatty oils.

A further object is to enable the use of relatively small amounts of clay and other refining materials and to eliminate many refining steps so as to hold down the overall cost of refining.

Another aspect of the invention relates to pretreatment of the crude oil to remove trace metals, before the steam deodorization step.

A still further object is to produce economically a refined glyceride oil having a low color value and suitable for use in margarine or foods.

Trace metals, especially such as copper (Cu) and iron (Fe) are harmful to vegetable oils, especially in regard to their stability. It has now been found that these trace metals are especially harmful if they are present during the high-temperature treatment which is necessary for steam refining and deodorization. Heretofore, there was no appreciation of the extent of the trace metal problem and its effects on steam refining, nor were adequate measures practical for the removal of these trace metals.

Thus, other important objects of the invention are (1) to prevent the accumulation of trace metals in the oil before and during the refining process, and (2) to reduce greatly the trace metal content of the oil during the early steps of the refining process in order to improve the effectiveness of steam refining and deodorization.

Achieving these objects makes it possible for the steam refining process to be adequate without incorporating any caustic refining process.

SUMMARY OF THE INVENTION

The present invention employs several important features, including:

(1) keeping the crude oil and the oil being processed away from sources of trace metals, especially reactive Fe and Cu, and also excluding oxygen from access to the oil during the processing, (2) pretreating the oil with phosphoric (or, less desirably, citric) acid, (3) using "bleaching" clays to reduce the amount of trace metals that are present as well as for bleaching. By use of feature (1), the amount of clay consumed can be kept low, (4) then using steam refining —and no caustic refining, (5) employing a novel steam-refining procedure, (6) employing novel energy-conserving procedures, and (7) fractionating and recovering separately substantially all of the fatty acids as our product and odoriferous substances as another product, in conjunction with a condensing process.

According to this invention, processing of the crude oil to a finished product is a continuous operation that eliminates storage (except surge storage) at any intermediate stage.

Briefly stated, the process comprises blanketing the oil with inert gas (except where the oil is treated under vacuum conditions) and sequentially doing the following steps:

(a) pretreating the phospholipid-free oil with a suitable acid (preferably phosphoric acid) to react the acid with such trace metals as are present, (b) mixing the pretreated oil with absorption bleaching clay, preferably acid-activated clay; the clay can be kept below two and one-half percent, suitably from about 0.2% to about 2.5% by weight, usually being about 1½ to 2% of the weight for palm oil treated, about 0.5–0.8% for coconut oil, about 0.5% for soybean oil, and usually as low as 0.2% for tallow, advantageously at a temperature of from about 200° F. (93° C.) to about 260° F. (127° C.), (c) in some instances adding small amounts (e.g., about 0.05% up to about 0.2% by weight) of water or steam to improve oil color, (d) filtering the clay from the oil, the clay carrying with it most of the undesirable trace metals and a significant portion of the color bodies, (e) steam-stripping the oil under a high vacuum (1–10 mm Hg) in three main but overlapping stages, namely, (1) deaeration with steam (2) deacidification with steam at about 210° C. to 275° C., depending on the oil being processed, and (3) deodorization with steam, and (f) cooling the oil and, preferably, polish-filtering it.

Throughout the process, there is heating in some steps and cooling in others, and heat-exchange economization enables much of the heat and cooling and some of the steam used to be generated from the oil itself.

Oil and fatty material which splashes out of the trays used in steam sparging is recovered and re-treated.

A fatty-acid recovery system takes the material stripped from the oil during the steam refining process and processes it as follows:

(a) fractionation by surface condensation recovers a stream of the major portion of the fatty acids, which is then blanketed with inert gas, (b) further condensing recovers a further amount or stream of fatty acids, and this second amount is then blanketed with inert gas, (c) the sparging steam and steam added to the fatty acid stream after the steam-refining of the oil are condensed in a barometric condenser.

Throughout the processes, vessels are used which do not add trace metals to the oil being processed. Stainless steel and glass-lined vessels and piping may be used, for example.

Typical amounts, temperatures, and pressures will be discussed below.

Other objects and advantages of the invention will appear from a detailed description of the invention in conjunction with the drawing.

BRIEF DESCRIPTION OF THE DRAWING

In the drawing:

The drawing is a flow sheet of the refining of phospholipid-free crude vegetable oil according to a process embodying the principles of the invention.

DESCRIPTION OF A PREFERRED EMBODIMENT

The process shown in the flow diagram begins with pretreatment of the crude oil (or the degummed crude oil) with a suitable acid for reaction with the many trace metals commonly present. When crude oils containing phospholipids, commonly called phosphatides or gums, are to be pretreated and steam refined in my process, the phospholipids are first removed, as by the well-known processing technique of water hydration, with or without acid, and centrifugal separation of gums from the crude oil. Crude oils such as soybean oil, safflower seed oils and the like which contain gums, must be degummed prior to pretreatment for steam refining. Crude oils not containing gums, such as palm oil, all lauric acid oils and animal fats, may be fed directly to the pretreatment section of the process.

Thus, as shown on the flow sheet, the continuous processing begins by withdrawing the crude or degummed crude oil at ambient temperatures and up to about 120° F. (49° C.) from a storage tank 1 via a line 2 by a pump 3. The tank 1 may be made from stainless steel or fiberglass or other materials not providing trace metals in reactive form, and, similarly, appropriate piping is used throughout. The tank 1 is preferably agitated, and the crude oil therein is insulated under inert-gas blanketing, as from a nitrogen line 4, to protect the crude oil from oxidation and degradation. Preferably, crude palm or coconut oil is stored at about 120° F. (49° C.) under its inert atmosphere. Other oils may be stored at about the same or different temperatures, depending on their characteristics, etc.

The oil in the line 2 is then mixed at station 5 with a stream 6 of phosphoric or citric acid and sent to an acid pretreatment vessel 7, which has an agitator 8 and which is provided with a heating coil 9 in order to provide a desired reaction temperature.

While several acids are usable, the results from the use of citric or phosphoric acid have proved to be the best, and, of these phosphoric acid is the better of the two. The oil is preferably premixed with 0.05 to 0.08% of technical grade (75%) phosphoric acid, by weight of the oil. (This is about 0.03 to 0.06% $H_3PO_4$.) In the event that citric acid is used, about 0.06 to 0.12% thereof (or about twice the amount of phosphoric acid) is useful. The pretreatment vessel 7 is a closed vessel of stainless steel or glass or other trace-metal-free or acid-resistant material, where treatment lasts from about five minutes up to about thirty minutes, usually about fifteen minutes, under an inert gas, usually nitrogen from a stream 9*a*, applied at a slight positive pressure to exclude air. The oil is maintained at a constant temperature, the operating range being between about 50° C. and about 60° C., but preferably at or near the lower end of the temperature range to avoid corrosion of the reaction vessel 7.

The pretreated oil then flows continuously via a line 10 to a mixing tank 11 where it is mixed with absorptive bleaching clay coming from a storage tank 12 via a feeder 13 and a line 14. Acid activated clay, such as Filtrol 4, Filtrol 105 or the like, may be added in amounts varying between 0.2% and 2.5% by weight of the oil. The amount of clay employed varies with the type of oil treated and the final oil color desired. Thus, for palm oil about 1.5–2% is used; for coconut oil about 0.5 to 0.8%; for soybean oil about 0.5%; and for tallow about 0.2%. The mixture of oil, acid, and clay is pumped by a pump 15 through a line 16. Optionally, the mixture may be pumped through a mixing zone 17 where small amounts of water, or water as steam, are added from a line 18, the amounts varying from about 0.05% to about 0.2% by weight of the oil, preferably about 0.1%, to aid in getting better oil color, and then through an economizer heat exchanger 19 to a vacuum bleacher vessel 20. Economizer heat exchangers or "*economizers*" are well-known pieces of convenient heating and cooling equipment. Heat is removed from the oil leaving the vacuum bleacher 20 via the stream 26 by heat exchanger that preheats the feed oil from the line 16 before it reaches the vacuum bleacher 20.

Thus, the preheated oil from the economizer 19 flows to the vacuum bleacher vessel 20, which has an agitator 21 and a heating coil 22. A vacuum is drawn on the vessel 20 via a line 23, and the vessel 20 is maintained under a high vacuum in the range of about 1 to about 40 mm Hg. absolute pressure, preferably at about 10–12 mm Hg., preferably using a conventional three-stage steam vacuum system. The oil is deaerated, preferably by being pumped into the vacuum vessel 20 in such a way as to flow across the vessel wall tangentially. The heating coils 22 are in the lower portion of the vessel 20 and serve to raise the oil temperature to a value within a range between about 200° F. (93° C) and about 260° F. (127° C.) The best results for palm oil seem to be obtained at about 250° F., and it has been found that temperatures higher than that give poorer results, apparently due to the effect on $\beta$-carotene, which forms products at high heat that give trouble later. The oil is held in this vessel or zone 20 for about ten to about 30 minutes, preferably about 15 minutes. The oil may be heated by passing steam or some other heating medium from a line 24 through the coils 22.

During the clay contact stage, trace metals which have reacted with the acid in the previous step to form a metal complex, are absorbed by the clay, along with any phospholipid or complex thereof which may be present, as due to not having been removed by a prior water degumming step. Color bodies are likewise reduced due to the absorptive clay present. Using the Lovibond system of color measurement, and palm oil as an example, the color on crude palm oil has ranged from 30Y–20R to 45Y–22R, all in a 25.4 mm column color tube. (Note that the standard glass tube for color measurement employs a 133 mm deep column of oil; however, crude palm oil is so red that only a 25.4 mm depth can be read.) The inventor has treated palm oil according to the process first described using only 1.5% of an acid-activated clay and found the color greatly reduced, with a color reading, after prebleach, ranging from 6 red to 15 red, typically in the 30Y–10R range on a 133 mm column. However, color alone at this stage does not tell the whole story, for it has been found that while heat bleaching at higher temperatures than 260° F. (127° C.) can reduce the color values at this stage, the color after steam refining is not as good, and other undesirable reactions occur that affect taste and other indicia of quality.

The oil-clay mixture is then sent by a pump 25 via a line 26 through the economizer 19 for simultaneously heating the oil from the line 16 about to enter the bleacher vessel 20 and cooling the oil leaving the bleacher vessel 20. From the economizer 19, the mixture is continuously conducted by a line 27 to a filter 28, where the oil is filtered to remove the clay and the products of the phosphoric acid reaction. Standard plate filters may be used. This concludes the pretreatment process.

The pretreated oil has thus been freed from trace metals so that it can be effectively subjected to steam refining. A substantial portion of the color bodies and some other impurities have been removed.

The pretreated filtered oil is then sent via a line 29 to a series of steam strippers where it is heated to a temperature in the range of about 210° C. to about 275° C., with steam sparging through the oil, under about 1 to about 10 mm Hg. absolute pressure, to accomplish deacidification or fatty acid removal and deodorization. The process may employ equipment similar to that of conventional steam deodorization, such as that shown in the to Bailey, U.S. Pat. No. 2,691,665, with certain modifications, using Dowtherm, hot circulating mineral oil or the like, or high pressure steam as the heating medium. As the oil passes through the steam stripper under 1 to 10 mm Hg. absolute pressure, the free fatty acids are removed through the vacuum system, and the oil is completely deodorized.

To be more specific: after filtration, the filtered oil is preferably stored in an intermediate surge tank 30, either under a blanket of nitrogen or other inert gas from line 31 or under vacuum, to avoid contact with air. By means of a charge pump 32 the oil may be sent from the surge tank 30 through a line 33 to an economizer heat exchanger 34 for preheating the oil prior to its entering the deacidification stage. Then the preheated oil may be sent through a heat exchanger 35 for further heating, when desired, employing steam, oil Dowtherm or other heating medium in coils, and on to a charge tank 36.

It is apparent that the economizer 19 may be replaced by a preheater for the oil in the line 16 going to the vacuum bleacher vessel 20 and a cooler for the oil going out of the bleacher vessel 20 through the line 16. Similarly, the economizer 34 may be replaced entirely by extracting more energy from the heat exchanger 35 and by providing a suitable cooler. However, the economizers 19 and 34 are illustrated in the flow sheet and described herein because they have been found to increase the economy of operation in the practice of the present process and because they represent means of recovering usable heat.

The heat exchanger 35 may be used only on initial start-up of the process, before hot oil becomes available from the vacuum distillation step. The heat exchanger 35 may also be used as a main source of heat or may be used when processing certain oils which are deacidified at lower temperatures, as more fully explained hereinafter, as a means of adding such additional heat as is needed to the oil after passing through the economizer 34.

On a timed basis, a batch or lot of oil is pumped by the pump 32 to the charge tank 36. For further deaeration, the charge tank 36 may be under vacuum and have a steam sparger 37 using 0.1%–0.3% steam, based on the weight of the oil. On a timed basis, oil is transferred, as by gravity, from the charge tank 36 through a line 38 and a valve 39 to a vacuum vessel 40, where it goes to the top tray 41. The tank 36 may be a separate tank as shown, or it may be the top tray in the vessel 40, either with the tray 41 below it or with the tray 41 omitted. Each tray in the vacuum vessel 40 may be the same size, and the capacity of the charge tank 36 may be the same as the capacity of each tray in the vacuum vessel 40. For some uses, the top tray 41 or the charge tank 36 or both may be larger, but, preferably, all batch transfers are for the same amount and the holding time are preferably identical.

As previously stated, the entire vacuum vessel 40 is operated at a high vacuum, between 1 mm to 10 mm Hg. absolute pressure. The top tray 41 may contain heating coils 42 for heating the oil to an optimum deacidification temperature, usually between about 210° C. and about 275° C., depending upon the oil being processed. The heating medium from line 43 to the heating coils 42 may be Dowtherm, hot circulating mineral oil or the like or high pressure steam. Alternatively, the heat for this stage may be supplied solely by the heat exchanger 35.

Below the tray 41 are preferably two other trays, a central tray 44 and a bottom tray 45. At each tray, sparging steam from a line 46 is introduced through the oil, using a series of perforated pipes or spargers 47, 48, and 49, each, respectively, lying along the bottom of a tray 41, 44, or 45. Other suitable means of distributing the steam may be used. In the top tray 41 the steam is introduced by the sparger 47 mainly for the purpose of agitation and better heat transfer, for example, in amounts varying between 0.2% to about 1.0% by weight of the oil. The holding time in the tray 41 coincides with the timing for each succeeding tray 44 and 45 as well as for the charge tank 36 and usually varies from about 6 minutes to about 30 minutes, preferably from 15 minutes. This processing in the top tray 41 accomplishes deaeration of the oil (i.e., lowering the dissolved oxygen content to less than 0.1% by volume), drives off low-boiling volatiles, and begins the deacidification and deodorization.

From the top tray 41 the oil is next dropped to the main deacidification tray 44 where larger amounts of steam are sparged through the oil by the sparger 48, usually in amounts of about ¾% to about 4% by weight of oil. Here, the free fatty acids are reduced from a range of about 3% to 8% in the crude oil to a range of about 0.1% to about 0.5%.

The largely deacidified oil is then dropped to the bottom tray 45 for final deacidification and complete deodorization, again for the same period of time as in the prior tray 44, and sparged with about ¾% to about 4.0% steam (per weight of the oil) from the sparger 49. The temperature is still near the optimum temperature selected for the particular oil being processed. In the tray 45, the free fatty acid content is reduced to a range of about 0.01% to about 0.05% of the weight of the oil, and the oil is fully deodorized.

During the high temperature treatment under vacuum and sparging steam in the vessel 40, the oil is also heat bleached by destroying the carotene, xanthophylls and other heat destroyable color bodies.

On many oils low in free fatty acids in the crude state, the deacidification and deodorization may be completed in one deodorization tray where the overall vacuum vessel 40 may then contain only one deacidification/-deodorizing tray, with sparging as for the central tray 44. With such oils, or for that matter with any oil so long as there are appropriate adjustments, the preheater 35 may accomplish all the heating needed in the process. For other oils two trays may be sufficient.

The oil from the final deodorization tray 45 may be dropped, on a timed basis, to a surge holding zone 51, still under high vacuum, 1 to 10 mm Hg., and essentially at the optimum deodorization temperature. This holding zone 51 may be a separate vessel or a part of vacuum vessel 40.

The oil from the holding zone 51 is continuously transferred by a pump 52 and a pipeline 53 through the economizer 34, for transfer of heat to the incoming feed stock in the line 33. From there, the oil goes to a heat recovery unit 54, which is a waste-heat boiler.

The waste-heat boiler 54 or heat recovery system basically comprises a tube-type water boiler where hot oil from the pipeline 53 flows through tubes surrounded by softened water from line 55, the hot oil giving up heat to vaporize the water into usable steam. Waste-heat boilers in other milieu are not novel, but it is believed to be novel to recover heat from hot deodorized oil, as in this process. The low-pressure steam generated may be held in an accumulator 56 any may be sent by a line 57 for process heating, such as steam sparge in the deacidification and deodorization process, for heating storage vessels, for steam tracing of pipeline, or myriad uses. In practice, the steam accumulator 56 may be connected to a source of low pressure steam from the normal plant steam boiler. When steam generation in the waste-heat boiler 54 is low, due to process interruptions, low pressure, regulated steam supplements the waste-heat boiler steam.

By using the economizer 34 and the waste-heat boiler 56 between about 70% and about 80% of the heat added to the oil in the heating tray 41 can be recovered as usable energy.

From the waste-heat boiler 56, the partially cooled oil passes on through a final water-cooled heat exchanger 58, and through a polish filter 59, to a finished deodorized oil storage zone 60 which is under inert gas blanketing, usually nitrogen from a line 61, and is maintained at a temperature between 30°–50° C.

If the operation is carried out in stainless steel tanks (or other tanks that do not react with the oil) the oil and fatty material from a lower or intermediate shell 62 of the vacuum vessel 40, which lies between the bottom tray 45 and the surge tank 51, may be recovered or reused. This material continually drains via a line 63 to a collection tank 64, from which it may be periodically transferred to the pretreatment vessel 7, as via a line 65.

This material consists principally of oil which has splashed out of the steam sparged trays 41, 44, and 45, along with a small amount of free fatty acids which may have refluxed down the wall of the vacuum vessel 50.

The vacuum system and the fatty acid recovery system will next be described. A practical system for creating the high vacuum, which is well known in industry, comprises a thermocompressor section 70, which may be one thermocompressor, commonly termed a "*booster*" or may be two in series, a barometric water condenser 71, a two-stage ejector system 72, and with a barometric water intercondenser 73. With a three-stage ejector system, the usual vacuum created in the vacuum vessel 40 will vary between 4 to 8 mm Hg. absolute pressure. With a four-stage ejector system, that is, with two "*boosters*" in series, the vacuum created may vary between 0.5 mm to 3 mm Hg. absolute pressure.

In my flow diagram, I show a vacuum line 74 leading from the vessel 40 to a surface condenser 75, which is interposed between the vacuum vessel 40 and the first booster 70. While the use of surface condensers in fatty acid distillation are known in the art (See *Refining of Oils and Fats,* by A. J. C. Anderson, Ind. Eg., 2nd Revised Edition, Macmillen, p.95, New York 1962), my use here is novel, as the surface condenser 75 acts in a new manner, that is, to separate free fatty acids from substantially all, or objectionable amounts of, odor-causing constituents of the incoming oil, and for steam deacidifying fats which contain fatty acids. This process is applicable to steam refining saturated fats such as palm oil, lauric acid fats like coconut and palm kernel, and animal fats, as well as unsaturated fats such as, e.g., soy oil. The surface condenser 75 may be inside the vessel 40 instead of outside it, if desired.

The vapor stream leaving the vacuum vessel 40 via the line 74 consists of sparge steam, high-melting-point fatty acids, low-melting-point fatty acids, a small amount of entrained fat and other volatile non-fat material. The surface condenser 75 has suitable cooling coils 76, to which a cooling liquid is supplied. By controlling the temperature of the cooling coils 76 in the surface condenser 75, as by using warm water or any other cooling medium, a major amount of the fatty material is condensed to a liquid without condensing either the sparge steam or odoriferous material. I have found that if the warm water is kept in the range of 80°–100° C., fatty acids from palm oil are condensed without condensing odoriferous material, color bodies, unsaponified fats and other objectionable material, and these fatty acids may either be esterified or sold for good prices. The condensed major portion of the fatty acids is then carries out by a line 78 and collected in a tank 79. The liquid level in the tank 79 is kept constant, and excess material is continuously pumped out by a pump 80 via a line 81 to a storage tank 82, which is protected from oxidation by inert gas blanketing, as by nitrogen, from line 83.

The fatty material which is not condensed in the surface condenser 75, such as the remaining portion of the fatty acids and odoriferous material, along with the sparge steam, passes via a line 84 to and through the thermocompression section 70, comprising a booster or boosters, and from thence via a line 85 to the final fatty material condenser 86, where nearly all the volatile fatty material is condensed. This condenser 86 may use the well-known system of passing the vapors through a fine spray of condensed and cooled fatty acids from a nozzle 87, usually at 50° C. to 60° C., with the sparging steam and the booster motive steam passing on via a line 88 to the water-cooled barometric condenser 71, where they in turn are condensed by the cold water spray from line 89 in the barometric condenser 71. The sparging steam from the charge tank 36 is also carried to the barometric condenser 71 by a vacuum line 90.

The scrubber 86 may collect the condensed liquid in a sump 91, having a heat exchanger 92 for maintaining the desired temperature. Or the condensed liquid may be otherwise collected and cooled. The remaining condensed fatty acids are collected from the scrubber vessel 86 along with odoriferous material, sterols and others. A portion of these is recirculated by a pump 93 from the withdrawal line 94 to a line 95 leading to the spray nozzles 87, while the remainder is continuously pumped via a line 96 to a separate storage vessel 97 and is protected from oxidation by inert gas, such as nitrogen, from a line 98.

The barometric condenser 71, the ejector 72 and the barometric intercondenser 73 empty condensed waste into a collection tank 100 through respective lines 101, 102, and 103, while uncondensed gases (which are free from toxic materials) flow into the atmosphere.

While the second condenser 86 is shown after the booster section 70 of the vacuum system, it may be placed ahead of the booster 70, as for example, between the surface condenser 75 and the booster 70. In theory, either location will efficiently remove condensable material; however, in actual practice, it is only economics which dictate costs of the vessel and its location.

EXAMPLE I

The process of this invention was used to steam refine and steam deodorize a typical crude palm oil by the series of steps described above. The free fatty acid of the particular crude palm oil, used for this series of tests, was 3.2% as palmitic acid. A series of tests were run to note the effect of various amounts of bleach clay while maintaining bleach vacuum and temperature constant, as well as deacidification vacuum and temperature. All oils were pretreated with 0.07% of 75% phosphoric acid at about 50° C. for 15 minutes. The vacuum bleacher was maintained at 10 mm Hg. with the oil at 250° F. (121° C.) and the holding time was fifteen minutes. The steam deacidification and deodorization steps were maintained at 2 mm Hg. and the oil at about 275° C. Sparge steam was not closely measured but was in the ranges previously described.

| Test | Percent Clay | Finished Deodorized Color |
|---|---|---|
| 1 | 0.5 | 30Y-3.0R |
| 2 | 1.0 | 20Y-2.0R |
| 3 | 2.0 | 15Y-1.5R |

(All Lovibond colors were read at a 133 mm column.)

All finished deodorized oil had a free fatty acid content of 0.02%–0.03% and was fully deodorized to a bland, high quality edible oil.

EXAMPLE II

Palm oil, previously described as being pre-treated to give a Lovibond color of 30.0Y–10.0R was steam-refined as described above under a vacuum of 5 mm Hg. The steam sparged was in total 3.5% by weight of the oil. The final color was 15Y and 1.5R, and the oil was deodorized.

EXAMPLE III

Crude coconut oil was steam refined using my process, as described above. The crude oil had a free fatty acid of 3.5% as lauric acid. The crude oil was pretreated with 0.1% phosphoric acid, according to my invention, heretofore described. This oil was bleached with 2.0% FIltrol 105 clay, at 10 mm Hg. absolute pressure at 220° F (1040 C.). The filtered pretreated bleached oil was steam refined at 2 mm Hg. and 240° C using the method herein described. The finished oil was fully deodorized with a color of 6Y–0.6R.

EXAMPLE IV

Crude animal tallow was treated according to this process, using 0.05% (by weight of the tallow) of phosphoric acid and 0.2% bleaching clay. The steam refining was conducted at 236° C. using sparging steam in the total amount of 4% of the weight of the oil. The finished deodorized oil had a color of 1Y–0.1R and a free fatty acid content of 0.01%.

EXAMPLE V

Crude soya bean oil may be degummed by any of various procedures, with or without acid treatment. In one specific instance, soya bean oil having 0.3% free fatty acids was degummed by adding thereto 0.05% of 85% phosphoric acid and 1% of water, both by weight of the oil, using a line mixer. This mixture was held in a tank for about 45 minutes (30 minutes to 60 minutes is the range of normal treatment times), and the mixture was then centrifuged, and the phospholipids removed.

The substantially phospholipid-free soya bean oil was then pretreated by phosphoric acid (0.1% by weight of the oil) per the above-described process, followed by adding clay (Filtrol #4, 0.5% by weight of the oil). After 15 minutes at 250° F. (121° C), the mixture was cooled and then filtered. Next, steam refining as described above was done at 270° C. at a pressure of 6 mm, the steam sparging being in the specified ranges and totaling 3% by the weight of the oil.

The resultant purified soya bean oil had a free fatty acid content of 0.03% and a Lovibond color of 2Y and 0.3R, with a maximum of 0.4% conjugated dienes (as contrasted with about 0.9% conjugated dienes when treatment with phosphoric acid and clay is done at 300° F. (159° C.)).

EXAMPLE VI

Crude palm oil was mixed with 0.08% by weight of 75% phosphoric acid and held, while mixing, for 15 minutes under nitrogen. To each of four batches of this oil was then added 2%, by weight of the oil, of acid-activated clay and each batch (Tests 1, 2, 3, and 4) held for one-half hour while agitating under vacuum (10 mm Hg.) at the respective temperatures shown in the Table below. At the end of the half hour the oil was cooled and filtered, and then steam refined at 270° C. under 5 mm Hg. with stripping steam as described above in Example I.

TABLE

THE EFFECT OF BLEACHING TEMPERATURES ON FINISHED PALM OIL COLOR

| Bleached Temperature | Bleached Color (Lovibond) | Steam Ref. Temp. (° C.) | Steam Refined Color (Lovibond) | F.F.A. % by Wt. |
|---|---|---|---|---|
| (I) 200° F. (93° C.) | 70Y-14.0R | 270 | 20Y-2.0R | 0.2 |
| (II) 250° F. (121° C.) | 46Y-11.5R | 270 | 19Y-1.8R | 0.2 |
| (III) 300° F. (159° C.) | 46Y-5.3R | 270 | 20Y-2.1R | 0.2 |
| (IV) 350° F. (177° C.) | 40Y-4.2R | 270 | 23Y-2.3R | 0.2 |
| All bleached with 2% of clay | | | | |

Y = Yellow
R = Red

It can be seen that best results in the final oil are obtained, in this process, by bleaching at about 250° F. (1210° C.). However, temperatures of from about 200° F. (93° C.) to about 260° F. (127° C.) are useful to reduce the red color value to not over 2.0 (Lovibond). At the same time, the fatty acids are reduced to 0.2%, which is quite satisfactory. The color reduction in the final oil is not correlative to that obtained at the bleaching step but depends upon the temperature at the bleaching step.

To those skilled in the art to which this invention relates, many changes in construction and widely differing embodiments and applications of the invention will suggest themselves without departing from the spirit and scope of the invention. The disclosures and the description herein are purely illustrative and are not intended to be in any sense limiting. Parts and percentages are by weight unless otherwise indicated.

I claim:

1. A process for refining crude vegetable oils containing phospholipids, trace metals, carotene and free fatty acids, comprising:
   (1) degumming the crude oil to remove almost all the phospholipids,
   (2) treating the degummed crude oil with weak acid and bleaching clay at temperatures between 200° F. and 260° F. (93° and 127° C.) to remove enough trace metals therefrom to render the oil substantially free from trace metals and to remove carotene to a level of no higher than about 30 ppm,
   (3) deaerating the treated oil,
   (4) steam-stripping the deaerated oil under vacuum conditions and at a temperature in the range of about 210° C. to 275° C. to remove free fatty acids while also bleaching it and deodorizing it.

2. A process for refining crude vegetable oils containing phospholipids, trace metals, carotene and free fatty acids, comprising:
   (1) degumming the crude oil to remove almost all the phospholipids,
   (2) treating the degummed crude oil at temperatures between 200° and 260° F. (93° and 127° C.) to remove enough trace metals therefrom to render the oil substantially free from trace metals and to remove carotene to a level of no higher than about 30 ppm,
   (3) deaerating the treated oil,
   (4) steam-stripping the deaerated oil under vacuum conditions and at a temperature in the range of about 210° C. to 275° C. to remove free fatty acids while also bleaching it and deodorizing it, said treating step (2) including the following sequential steps:

(a) reacting the trace metals in the crude oil with a weak acid chosen from the group consisting of phosphoric and citric acids.

(b) mixing therewith bleaching clay in amounts depending upon the amount of acid, the color bodies in the crude oil, and the color ultimately desired, (c) deaerating the mixture and holding it under vacuum conditions and raising its temperature to a value in the range between about 200° F. (93° C) and about 260° F. (127° C.) and maintaining at said temperature until the carotent and the reaction products of the trace metals and acid are absorbed by the clay, as are color bodies and traces of phospholipids or complexes thereof, and (d) filtering the mixture to remove the clay, with attendant color bodies and the reaction product of the acid and trace metals.

3. The process of claim 2 wherein the reacting step (a) comprises mixing the crude oil with phosphoric acid in amounts of about 0.03% to about 0.06% $H_3PO_4$ by weight of the oil and holding it in a closed vessel for about five to about thirty minutes under a blanket of inert gas at a slight positive pressure, between about 50° C. and about 60° C.

4. The process of claim 3 wherein step (c) comprises maintaining the vacuum in the range between about 1 mm and about 40 mm Hg. and the time of reaction is in the range between about 10 and about 30 minutes.

5. The process of claim 2 wherein the bleaching clay is used in amounts between 0.2% and 2½% of the weight of the oil.

6. The process of claim 1 wherein the oil in step (4) is in a vacuum of 1–10 mm Hg. and is sparged by steam a total amount between about 0.75% and about 4% by weight of the oil.

7. A continuous process for refining phospholipid-free crude vegetable oils containing carotene and trace metals, comprising:

(1) treating the crude oil with weak acid and bleaching clay at a temperature of from 200° F. (93° C.) to 260° F. (127° C.) and for a time sufficient to remove enough trace metals therefrom to render the oil substantially free from trace metals and to remove more than 90% of the carotene therefrom without producing any significant amount of carotene heat degradation products, (2) separately recovering the treated oil substantially free of trace metals and of 90% of said carotene, (3) deaerating the treated oil, so recovered, (4) steam-stripping the deaerated oil under vacuum conditions and at a temperature in the range of about 210° C. to 275° C. to remove free fatty acids while also bleaching it and deodorizing it, (5) passing the distilled-off fatty acids and other volatilized waste material via a vacuum line, (6) condensing and recovering a major amount of free fatty acids, and then (7) condensing and recovering the remaining free fatty acids and odoriferous material.

8. A continuous process for refining crude vegetable and animal oils that are substantially free from phospholipids, comprising:

conducting the following treatment steps in vessels that exclude the oil from picking up trace metals during treatment while also excluding oxygen from the oil while sequentially performing the following steps:

(1) reacting the trace metals in the crude oil with acid, (2) mixing therewith bleaching clay in amounts depending upon the amount of acid, the color bodies in the crude oil, and the color ultimately desired, (3) deaerating the mixture and holding it under vacuum conditions and raising its temperature to the range between about 200° F. (93° C.) and about 260° F. (127° C.), and maintaining at said temperature for a sufficient time, so that the reaction products of the trace metals and acid are absorbed by the clay, as are more than 90% of contained carotene and color bodies and traces of phospholipids or complexes thereof, (4) filtering the mixture to remove the clay, with attendant carotene, color bodies and the reaction product of the acid and trace metals, (5) deaerating the filtered oil under vaccum with steam sparging through the oil, (6) heating the oil in a vacuum at between 1 mm and 10 mm Hg. to a temperature lying in the range of about 210° C to about 275° C., (7) sparging the heated oil with steam to reduce drastically the free fatty acid content of the oil while also bleaching it and deodorizing it, (8) cooling the oil, (9) passing the distilled-off fatty acids and odoriferous and other waste material and steam after sparging, from steps (6) and (7) via a vacuum line,

(10) condensing and recovering a major portion of the fatty acids, and then

(11) condensing and recovering the remaining fatty acids and odoriferous material.

9. A process as in claim 8 wherein there is also added in step (2) water in small amounts up to about 0.2% of the weight of the oil, to aid in decolorizing.

10. A process for refining crude palm oil comprising:

conducting the following treatment steps in vessels that exclude the oil from picking up trace metals during treatment while also excluding oxygen from the oil while sequentially performing the following steps:

(1) admixing with the palm oil phosphoric acid in an amount sufficient to react with trace metals in the crude oil, (2) mixing with the palm oil-acid mixture bleaching clay in an amount depending upon the amount of acid, the color bodies in the crude oil, and the color ultimately desired, (3) deaerating the mixture and holding it under vacuum while raising its temperature to from about 200° F. (93° C.) to about 260° F. (127° C.) whereby the clay absorbs undesired materials including the reaction products of the trace metals and the acid, more than 90% of carotene contained in said crude oil, color bodies and phospholipids or complexes thereof, (4) filtering the deaerated mixture to remove the clay and its absorbed undesired materials, (5) deaerating the filtered oil under vacuum with steam sparging through the oil, (6) heating the oil in a vacuum at between 1 mm and 10 mm Hg. to a temperature lying in the range of about 210° C. to about 275° C., (7) sparging the heated oil with steam to reduce drastically the free fatty acid content of the oil while also bleaching it and deodorizing it, (8) cooling the oil, (9) passing the distilled-off fatty acids and other waste material and steam after sparging, from steps (6) and (7) via a vacuum line,

(10) condensing and recovering a major portion of the fatty acids, and then

(11) condensing and recovering the remaining fatty acids and odoriferous material.

11. A process as defined in claim 10 wherein said mixture is deaerated and heated at about 250° F. in step (3).

12. A process as defined in claim 10 wherein said phosphoric acid is added in an amount of from 0.03% to 0.06% based on the weight of said oil.

13. A process as defined in claim 10 wherein said clay is added in an amount of from 1½% to 2% based on the weight of said oil.

14. A continuous process for refining crude vegetable and animal oils that are substantially free from phospholipids, comprising:

conducting the following treatment steps in vessels that exclude the oil from picking up trace metals during treatment while also excluding oxygen from the oil while sequentially performing the following steps:

(1) reacting the trace metals in the crude oil with acid, (2) mixing therewith bleaching clay in amounts depending upon the amount of acid, the color bodies in the crude oil, and the color ultimately desired, (3) deaerating the mixture and holding it under vacuum conditions between 1 mm and 40 mm Hg and raising its temperature to the range between about 200° F. (93° C.) to about 260° F. (127° C.), and maintaining it at said temperature for a sufficient time so that the reaction products of the trace metals and acid are absorbed by the clay, as are color bodies and traces of phospholipids or complexes thereof, (4) filtering the mixture to remove the clay, with attendant color bodies and the reaction product of the acid and trace metals, (5) deaerating the filtered oil under vacuum with steam sparging through the oil, (6) heating the oil in a vacuum at between 1 mm and 10 mm Hg. to a temperature lying in the range of about 210° C. to about 275° C., (7) sparging the heated oil with steam to reduce drastically the free fatty acid content of the oil while also bleaching it and deodorizing it, and (8) cooling the oil.

15. The process of claim 14 wherein heat exchange is employed between lines of the oil to obtain (a) part of the heating in step (3) and part of the cooling in step (4) and (b) part of the heating for step (6) and part of the cooling for step (9).

16. A process for refining crude vegetable and animal oils that are substantially free from phospholipids, comprising:

initially blanketing the oil under an inert gas and then conducting the following treatment steps in vessels that exclude the oil from picking up trace metals during treatment, which comprises sequentially performing the following steps:

(1) mixing the crude oil with phosphoric acid in amounts of about 0.03% to about 0.06% by weight of the oil and holding it in a closed vessel for about five to about thirty minutes under a blanket of inert gas at a slight positive pressure, between about 50° C. and about 60° C., to react trace metals in the oil with said acid, (2) mixing therewith bleaching clay in amounts depending upon the amount of phosphoric acid, the color bodies in the crude oil and the color ultimately desired, and ranging from about one-tenth of one percent to about four percent of the weight of the oil, (3) deaerating the mixture and holding it at a vacuum in the range of about 1 mm to about 40 mm Hg. for about 10 to about 30 minutes while raising its temperature to such range that the reaction products of the trace metals and phosphoric acid are absorbed by the clay, as are color bodies and traces of phospholipids or complexes thereof, so that color development when later heated is prevented, (4) cooling the mixture and filtering it to remove the clay, with attendant color bodies and the reaction products of the phosphoric acid and trace metals, (5) keeping the filtered oil from contact with oxygen while heating it and then deaerating it under vacuum by a small quantity of steam sparged through the oil, (6) heating the oil in a vacuum vessel at between 1 mm and 10 mm Hg. to a temperature in the range of about 210° C. to about 275° C., (7) sparging the heated oil with steam for at least one period of about six to about thirty minutes in an amount of about 0.2% to about 4% in each period to reduce drastically the free fatty acid content of the oil while also bleaching it and deodorizing it, and (8) cooling the oil.

17. The process of claim 16 wherein in step (2) water is added in an amount between 0.05% and 0.02% by weight of the oil.

18. The process of claim 16 wherein the distilled-off fatty acids and other waste material and steam after sparging, from steps (6) and (7) are treated by carrying them via a vacuum line to a surface condenser, there condensing and recovering a major portion of the fatty acids, passing the uncondensed material from the surface condenser to a scrubber-condenser, and there condensing and recovering the remaining fatty acids and odoriferous material.

19. A pretreatment process preparatory to steam-refining of crude vegetable and animal oils that are substantially free from phospholipids, comprising:

conducting the following pretreatment steps in vessels that exclude the oil from picking up trace metals during treatment while also excluding oxygen from the oil while sequentially performing the following steps:

(1) mixing the crude oil with acid that reacts with trace metals present in the crude oil in amounts sufficient to react the trace metals, (2) mixing therewith bleaching clay in amounts depending upon the amount of acid, the color bodies in the crude oil, and the color ultimately desired, and adding water in small amounts, up to about 0.2% of the weight of the oil, to aid in decolorizing, (3) deaerating the mixture and holding it under vacuum conditions and raising its temperature to the range of about 200° F. (93° C.) to about 260° F. (127° C.), and maintaining at said temperature for sufficient time so that the reaction products of the trace metals and acid are absorbed by the clay, as are color bodies and traces of phospholipids or complexes thereof, and (4) filtering the mixture to remove the clay, with attendant color bodies and the reaction product of the acid and trace metals.

20. A pretreatment process preparatory to steam-refining of crude vegetable and animal oils that are substantially free from phospholipids, comprising:

initially blanketing the oil under an inert gas and then conducting the following treatment steps in vessels that exclude the oil from picking up trace metals during treatment, which comprises sequentially performing the following steps:

(1) mixing the crude oil with phosphoric acid in amounts of about 0.03% to about 0.06% by weight of the oil and holding it in a closed vessel for about five to about thirty minutes under a blanket of inert gas at a slight positive pressure, between about 50° C. and about 60° C., to react trace metals in the oil with said acid, (2) mixing therewith absorbent clay in amounts depending upon the amount of phosphoric acid, the color bodies in the crude oil and the color ultimately desired, and ranging from about two-tenths of one percent to about 2½ percent of the weight of the oil, (3) deaerating the mixture and holding it at a vacuum in the range of about 1 mm to about 40 mm Hg. for about 10 to about 30 minutes while raising its temperature to the range of about 200° F. (93° C.) to about 260° F. (127° C.) so that the reaction products of the trace metals and phosphoric acid are absorbed by the clay, as are color bodies and traces of phospholipids or complexes thereof, and (4) filtering the mixture to remove the clay, with attendant color bodies and the reaction products of the phosphoric acid and trace metals.

21. The pretreatment process of claim 20 wherein in step (2) water is added in amounts of up to about 0.2% by weight of the oil, to aid in decolorizing.

22. A pretreatment process preparatory to steam refining of crude vegetable and animal oils that are substantially free from phospholipids, comprising:

blanketing the oil under an inert gas and conducting the following treatment steps in vessels that exclude the oil from picking up trace metals during treatment:

(1) mixing the crude oil with phosphoric acid in amounts of about 0.03% to about 0.06% by weight of the oil and holding it in a closed vessel for about five to about thirty minutes under a blanket of inert gas at a slight positive pressure, between about 50° C. and about 60° C., to react trace metals in the oil with said acid, (2) continuously flowing the mixture of oil and phosphoric acid to a clay mixing zone, (3) mixing therewith acid activated clay in amounts depending upon the amount of phosphoric acid, the color bodies in the crude oil and the color ultimately desired, and ranging from about two-tenths of one percent to about 2½ percent of the weight of the oil while also adding water as steam in amounts between about 0.05% to about 0.2% by weight of the oil, (4) preheating the oil-acid-clay-water mixture by heat exchange with the mixture undergoing step (6), (5) deaerating the mixture and holding it at a vacuum in the range of about 1 mm to about 40 mm Hg. in a closed vessel for about 10 to about 30 minutes while raising its temperature to the range of about 200° F. (93° C.) to about 260° F. (127° C.) so that the reaction products of the trace metals and phosphoric acid are absorbed by the clay, as are color bodies and traces of phospholipids or complexes thereof, (6) cooling the mixture by heat exchange with the mixture of step (4), (7) filtering the mixture to remove the clay, with attendant color bodies and the reaction product of the phosphoric acid and trace metals.

23. A steam-refining process for phospholipid-free and trace-metal-free vegetable oils, comprising:

(1) deaerating the oil under vacuum with steam sparging through the oil, (2) heating the oil in a vacuum at between 1 mm and 10 mm Hg. to a temperature lying in the range of about 210° C. to about 275° C., (3) sparging the heated oil with steam to reduce drastically the free fatty acid content of the oil while also bleaching it and deodorizing it, (4) cooling the oil, (5) passing the distilled-off fatty acids and other waste material and steam after sparging, from steps (2) and (3) via a vacuum line, (6) condensing and recovering high-melting-point fatty acids, and then (7) separately condensing and recovering the low-melting-point fatty acids and odoriferous material.

24. The process of claim 23 wherein the hot oil from step (3) is sent, before step (4) to a waste-heat steam boiler to recovery energy therefrom.

25. A steam-refining process for phospholipid-free vegetable oil that has been treated with oil and bleaching clay and filtered to remove trace metals therefrom, comprising:

(1) keeping the filtered oil from contact with oxygen and reactive trace metals while heating it and then deaerating it under vacuum by steam sparged through the oil in an amount of about 0.1% to about 0.3% by weight of the oil, (2) heating the oil in a vacuum vessel at between 1 mm and 10 mm Hg. to a temperature lying in the range of about 210° C. to about 275° C., (3) sparging the heated oil with steam for at least one period of about six to about thirty minutes in an amount of about 0.02% to about 4% in each period to reduce drastically the free fatty acid content of the oil while also bleaching it and deodorizing it, (4) cooling the oil, (5) carrying the distilled-off fatty acids and other waste material and steam after sparging, from steps (2) and (3) via a vacuum line to a surface condenser, (6) there condensing and recovering a major portion of the fatty acids, (7) passing the uncondensed material from the surface condenser to a scrubber-condenser, and (8) there condensing and recovering the remaining fatty acids and odoriferous material.

26. A steam-refining process for phospholipid-free and trace-metal-free vegetable and animal oils that have been treated with bleaching clay and filtered therefrom, comprising the steps of:

(1) charging the filtered oil to a charge tank and keeping it from contact with oxygen, (2) sending the oil from the charge tank to a heat exchanger where heat is extracted from the oil in step (8), (3) sending the oil from step (2) to a charge vessel and deaerating it there under vacuum with steam sparged through the oil in an amount of about 0.1% to about 0.3% by weight of the oil, (4) charging the oil from the charge vessel to a vacuum vessel at between 1 mm and 10 mm Hg. and heating the oil there to a temperature lying in the range of about 210° C. to about 275° C., (5) passing the oil in said vacuum vessel from a top tray to a central tray and from there to a bottom tray, each batch from the surge tank to the charge vessel, from there to the top tray and from tray to tray being of the same quantity and for the same time, namely, in the range of about 6 to about 30 minutes, (6) sparging the oil in the top tray by steam at the amount of about 0.2% to about one percent of the weight of the oil, (7) sparging the oil in each of the central and bottom trays with steam in the amount of about 0.75% to about 4% by weight of the oil, thereby reducing the free fatty acid content of the oil to no higher than 0.2%, while also bleaching and deodorizing it, (8) sending the oil from step (7) in heat exchange relation with the oil in step (2) to cool the oil from step (7), (9) sending the oil from step (8) to a waste heat boiler to recover energy therefrom by heating water for use as steam in the process, and

(10) cooling and polish-filtering the oil.

* * * * *

UNITED STATES PATENT AND TRADEMARK OFFICE

CERTIFICATE OF CORRECTION

PATENT NO. : 4,089,880

DATED : May 16, 1978

INVENTOR(S) : Frank E. Sullivan

It is certified that error appears in the above-identified patent and that said Letters Patent are hereby corrected as shown below:

Item [54], left column of cover page, "PROCES" should read --PROCESS--.
Column 7, line 39, "exchanger" should read --exchange--.
Column 9, line 28, "time" should read --times--.
Column 9, line 54, "from 15" should read --about 15--.
Column 10, line 41, "any may be" should read --and may be--.
Column 11, line 52, "carries" should read --carried--.
Column 13, line 8, "FIltrol" should read --Filtrol--.
Comumn 13, line 9, "(1040 C.)" should read --(104°C.)--.
Column 14, line 17, "(1210°C.)" should read --(121°C.)--.
Column 15, line 11, "carotent" should read --carotene--.
Column 18, line 35, "0.02%" should read --0.2%--.

Signed and Sealed this

*Twenty-first* Day of *November 1978*

[SEAL]

*Attest:*

RUTH C. MASON
*Attesting Officer*

DONALD W. BANNER
*Commissioner of Patents and Trademarks*